United States Patent [19]

Cena et al.

[11] Patent Number: 4,478,155

[45] Date of Patent: Oct. 23, 1984

[54] RAILWAY CONTAINER AND CAR

[75] Inventors: Lawrence Cena, Naperville; Ted D. Mason, Glen Ellyn, both of Ill.

[73] Assignee: Atchison, Topeka and Santa Fe Railway Company, Chicago, Ill.

[21] Appl. No.: 333,448

[22] Filed: Dec. 22, 1981

[51] Int. Cl.[3] ..... B60P 7/13; B61D 3/14; B61F 1/14; B65D 88/32

[52] U.S. Cl. ..... 105/355; 105/4 R; 105/238 R; 105/248; 105/375; 105/404; 105/416; 105/418; 105/419; 206/509; 220/1.5; 410/44; 410/68; 410/77; 410/90

[58] Field of Search ..... D12/36, 37, 40, 41; 34/46; 49/70; 98/6, 10; 105/4 R, 59, 238, 240, 243, 247, 248, 249, 250, 251, 257, 277, 308 R, 354, 355, 358, 359, 360, 362, 377, 378, 406 R; 114/56, 61, 77 R, 260, 344; 206/129, 509, 510, 511; 219/202; 220/1.5, 22, 71, 436; 222/561; 280/5 C; 294/69 R; 298/22 AE, 27; 366/213; 406/130; 410/5, 26, 44, 52, 53, 54, 68, 77, 90; 414/373, 387; 426/231

[56] References Cited

U.S. PATENT DOCUMENTS

| | | | |
|---|---|---|---|
| 190,542 | 5/1877 | Brooks | 105/359 |
| 468,588 | 2/1892 | Westover | 298/27 Xr |
| 820,240 | 5/1906 | Mulock | 105/243 |
| 1,715,683 | 6/1929 | Stevens | 220/72 |
| 1,813,357 | 7/1931 | Gilpin | 426/231 |
| 2,038,064 | 4/1936 | Stetson | 220/1.5 |
| 2,091,721 | 8/1937 | Soderberg, et al. | 105/406(A) |
| 2,126,949 | 8/1938 | Ditchfield | 294/69 R |
| 2,140,268 | 12/1938 | Moss | 105/249 |
| 2,144,945 | 1/1939 | Sutton | 220/71 |
| 2,269,617 | 1/1947 | Borstel | 220/71 |
| 2,463,255 | 3/1949 | Elliott | 105/59 |
| 2,596,838 | 5/1952 | Carver et al. | 414/608 |
| 2,660,341 | 11/1953 | Norbom | 406/130 |
| 2,777,597 | 1/1957 | Ruff | 206/509 Xr |
| 2,944,692 | 7/1960 | Farrell et al. | 220/436 |
| 2,989,929 | 6/1961 | Flowers | 105/4 R |
| 3,029,748 | 4/1972 | Ingram (A) | 105/406 R |
| 3,034,454 | 5/1962 | Tatarchuk | 105/243 |
| 3,080,096 | 3/1963 | Carfizzi | 220/1.5 Xr |
| 3,127,851 | 4/1964 | Auksel | 105/248 |
| 3,143,082 | 8/1984 | Austgen | 105/392.5 |
| 3,145,665 | 8/1964 | Hamilton | 105/377 |
| 3,158,383 | 11/1964 | Anderson | 280/5 C |
| 3,168,876 | 2/1965 | Clejan | 410/54 |
| 3,174,728 | 3/1965 | Mack | 366/213 |
| 3,214,052 | 10/1965 | Dike | 206/509 Xr |
| 3,194,144 | 7/1965 | Vander Linden et al. | 98/6 |
| 3,242,879 | 3/1966 | Bronlund | 410/45 |
| 3,252,431 | 5/1966 | Phillips | 105/360 |
| 3,253,556 | 5/1966 | Glaser et al. | 105/406 R |
| 3,260,223 | 6/1966 | Black et al. | 410/52 |
| 3,315,616 | 4/1967 | Beaver et al. | 105/248 |
| 3,357,371 | 12/1967 | Gutridge | 410/54 |
| 3,358,616 | 12/1967 | Brodhead | 410/44 |
| 3,415,205 | 12/1968 | Gutridge | 410/54 |
| 3,447,502 | 6/1969 | Leopold | 114/61 |
| 3,450,066 | 6/1969 | Kasprzycki et al. | 410/68 |
| 3,486,241 | 12/1969 | Coyle et al. (A) | 34/46 |
| 3,515,051 | 6/1970 | Pulcrano | 98/6 |
| 3,516,366 | 6/1970 | Bradford et al. | 105/370 |
| 3,529,552 | 9/1970 | Bolte (A) | 105/362 |
| 3,538,857 | 11/1970 | Mowatt-Larsen (A) | 105/270 |
| 3,556,036 | 6/1971 | Wells | 114/260 |
| 3,561,368 | 2/1971 | Giesking | 105/243 Xr |
| 3,580,185 | 5/1971 | Bridge (A) | 260/509 Xr |
| 3,584,564 | 7/1971 | Rollins | 98/10 |
| 3,595,175 | 7/1971 | Austill | 105/243 |
| 3,605,639 | 9/1971 | Ingram | 105/377 |
| 3,613,620 | 10/1971 | Generoso et al. | 114/61 |
| 3,654,872 | 4/1972 | Fearon (A) | 105/239 |
| 3,664,270 | 5/1972 | Stark et al. | 105/377 |
| 3,675,605 | 7/1972 | Knerr | 114/61 |
| 3,677,193 | 7/1972 | Pringle | 410/5 |
| 3,690,272 | 9/1972 | Ogle et al. | 410/77 |
| 3,694,925 | 10/1972 | Coyle et al. | 34/46 |
| 3,707,919 | 1/1973 | Adler | 105/377 |
| 3,710,730 | 1/1973 | Austgen et al. | 105/250 |
| 3,724,394 | 4/1973 | Pringle | 410/5 |
| 3,731,053 | 5/1973 | Coyle et al. | 219/202 |
| 3,776,144 | 12/1973 | Eislers | 105/406 R |
| 3,787,910 | 1/1974 | Taylor | 114/344 |
| 3,788,702 | 1/1974 | Toboll | 298/22 AE |
| 3,800,712 | 8/1974 | Krug, Jr. | 410/54 |
| 3,822,650 | 7/1974 | Fearon (B) | 105/239 |
| 3,823,681 | 7/1974 | Cushing et al. | 114/260 |

(List continued on next page.)

FOREIGN PATENT DOCUMENTS

| | | | |
|---|---|---|---|
| 223,416,717 | 1/1975 | France | 410/90 |
| 679981 | 9/1952 | United Kingdom | 105/272 |
| 1693 | 4/1980 | United Kingdom | 410/68 |

*Primary Examiner*—Howard Beltran

*Attorney, Agent, or Firm*—Willian Brinks Olds Hofer Gilson & Lione Ltd.

[57] ABSTRACT

An improved container for bulk cargo is provided with a peripheral wall, a top, and a bottom. The top defines a longitudinally extending central ridge and the bottom defines two spaced, parallel, longitudinally extending skirts separated by a central recess. The contour of the top generally corresponds to the contour of the bottom such that multiple containers can be stacked one over the other. The container is provided with a perforated floor which simultaneously braces the peripheral wall against spreading and provides a support surface for palletized cargo and the like. The floor perforations allow bulk cargo to fall from the upper portions of the container to the lower portions of the container. A bulk cargo loading door is provided in the top along the uppermost portion of the central ridge, and two bulk unloading doors are provided along the lowermost portions of the skirts. In addition, end doors are provided for moving palletized cargo into and out of the container. The container of this invention can be transported on a railway car of the type having an elongated central spine shaped to fit within the central recess of the container. This railway car defines four container attachment structures, each of which supports the container at a point well below the uppermost level of the spine. In this way, the center of gravity of the container is kept low and close to the ground.

33 Claims, 8 Drawing Figures

U.S. PATENT DOCUMENTS

| | | | |
|---|---|---|---|
| 3,831,792 | 8/1974 | Waterman et al. | 414/373 |
| 3,841,254 | 10/1974 | Dragonas et al. | 114/77 R |
| 3,854,423 | 12/1974 | Bridge | 410/54 |
| 3,868,913 | 3/1975 | Becker et al. | 105/240 |
| 3,871,278 | 3/1975 | Shoemaker | 105/378 |
| 3,896,945 | 7/1975 | Bjorklund et al. | 414/387 |
| 3,913,512 | 10/1975 | Kirby et al. | 114/260 |
| 3,918,604 | 11/1975 | Kersten | 220/22 |
| 3,995,541 | 12/1976 | Coyle et al. | 98/6 |
| 3,995,563 | 12/1976 | Blunden | 105/378 |
| 3,996,860 | 12/1976 | Ravani et al. | 49/70 |
| 3,980,185 | 9/1976 | Cain | 220/1.5 Xr |
| 4,009,664 | 3/1977 | Fearon (C) | 105/239 |
| 4,010,695 | 3/1977 | Mantione | 105/254 |
| 4,044,690 | 4/1977 | Deeks | 105/247 |
| 4,079,688 | 3/1978 | Diry | 114/56 |
| 4,082,357 | 4/1978 | Schmidt et al. | 298/27 |
| 4,084,516 | 4/1978 | Ravani et al. | 410/26 |
| 4,085,695 | 4/1978 | Bylo | 114/260 |
| 4,138,163 | 2/1979 | Calvert et al. | 406/129 |
| 4,144,820 | 3/1979 | Jaekle et al. | 105/355 |
| 4,179,997 | 12/1979 | Kirwan | 410/53 |
| 4,222,333 | 9/1980 | Schuller | 105/251 Xr |
| 4,230,048 | 10/1980 | Gordon et al. | 105/248 |
| 4,233,909 | 11/1980 | Adams et al. | 105/4 R |
| 4,236,458 | 12/1980 | Varda | 105/308 R |
| 4,241,665 | 12/1980 | Kleim | 105/4 R |
| 4,239,008 | 12/1981 | Conlon | 105/377 |
| 4,246,849 | 1/1981 | Gramse | 105/251 |
| 4,254,714 | 3/1981 | Heap | 105/406 R |
| 4,275,662 | 6/1981 | Adler et al. | 105/377 |
| 4,280,640 | 7/1981 | Daloisio | 222/561 |
| 4,292,898 | 10/1981 | Gordon et al. | 105/238 R |
| 4,361,097 | 11/1982 | Jones et al. | 105/406 R |
| D206,838 | 1/1967 | Hawes | D12/37 |
| D208,280 | 8/1967 | Sundberg (A) | D12/36 |
| D209,877 | 1/1968 | Sundberg (B) | D12/40 |
| D228,096 | 8/1973 | Hickman | D12/41 |
| D256,006 | 7/1980 | Cuccio et al. | D12/40 |
| D210,707 | 4/1968 | Munoz | D12/41 |

12
10
100
102
104
106
108
109
110
112
114
16
18
20
30
31
33
34
37
41
42
43
44
46
48
60
62
3.
4.

UPPER CARGO DOOR
END DOOR
LOWER CARGO DOOR
10
12
16
20
30
31
33
34
40
41
44
46
48
60
62
104
106
108
110
114

END DOORS
10
12
14
18
20
22
24
26
28
30
31
32
33
34
36
44
48
60
62
102
108
110
112
113
114

UPPER CARGO DOOR
END DOOR
UPPER CARGO DOOR
4.
4.
30
43
43
32
44
31
60
18
48
42
40
42
37
62
55
14
49
58
102
47
20
10
34
38
113
110
112
114
108
109
106
108
109

UPPER CARGO DOOR
LOWER CARGO DOORS
5.
5.
30
31
44
43
32
40
33
40
12
14
10
37
37
37
58
47
47
49
56
26
22
24
28
52
56
50
56
37
46
38
113
114
20
112
108
102
110
108
108
20
112
113
114
46

RAILWAY CONTAINER AND CAR

BACKGROUND OF THE INVENTION

This invention relates to an improved railway container for transporting bulk cargo on specially adapted railway cars, and to railway cars configured to transport such containers.

It has been recognized for some time that the containerized transportation of cargo provides significant advantages in terms of more efficient cargo handling. Cargo containers have come into wide use in the water, rail, and highway transportation of palletized cargo.

Adams U.S. Pat. No. 4,233,909 describes one modern approach to the transportation of trailers and other containers on specially constructed railway cars. The approach described in the Adams patent does provide important advantages over conventional railway flat cars, as described in the Adams patent.

However, the railway cars and containers described in the Adams patent suffer from certain limitations. In particular, when containers are transported on railway cars of the type described by Adams, the center of gravity of the cargo being carried is situated at a relatively high level, because none of the cargo is carried below the uppermost level of the railway car itself. Such a high center of gravity can be undesirable particularly when heavy cargos, such as bulk grains, for example, are being transported. In addition, containers such as those shown in the Adams patent are rectangular and do not therefore provide an aerodynamically contoured shape. For this reason, energy losses due to wind resistance around the trucks of the railway car and around the containers themselves are unnecessarily high. Moreover, many containers of the type shown by Adams are adapted for use with palletized cargo. Bulk cargos, such as grain or coal for example, often cannot be transported in such containers efficiently. This is due to the fact that many standard rectangular containers do not have adequate structural strength to contain a full load of a heavy bulk cargo.

It is accordingly an object of this invention to provide an improved cargo container and an improved railway car which cooperate to transport bulk cargos efficiently. Furthermore, this invention is directed to an improved container for bulk cargo which is strong and light in weight, which provides excellent aerodynamic characteristics when being transported on a railway car, which provides an exceptionally low center of gravity when used to transport bulk cargos, and which can be efficiently stacked for storage or transport.

SUMMARY OF THE INVENTION

According to a first aspect of this invention, an improved container is provided which comprises a peripheral wall, a bottom section secured to the lower edge of the wall, and a top section secured to an upper edge of the wall. The bottom section of this container defines a raised elongated central recess and a pair of longitudinally downwardly extending skirts, one on each side of the central recess. The top section of the container defines a central ridge positioned over the central recess of the bottom section such that the top section defines a contour which generally matches that of the bottom section to facilitate stacking of the container.

The container of this invention is configured to be transported on a railway car of the type having a central, longitudinally extending spine which is supported at each end by a respective truck. When the container is mounted on the railway car, the central recess of the bottom section overlies the spine of the car and each of the skirts is positioned alongside and below the top of the spine between the trucks. These skirts communicate directly with the interior of the container such that the skirts form a cargo carrying portion of the container.

In the preferred embodiment described below, a respective longitudinally extending lower bulk cargo hatch is provided along the lowermost portion of each of the skirts, and a longitudinally extending upper bulk clargo hatch is provided along the uppermost portion of the central ridge. In addition, this preferred embodiment includes a perforated floor extending across the interior of the container above the skirts, and an end door or side door mounted in the peripheral wall to admit palletized cargo into the container to be supported by the perforated floor. Preferably, this container makes extensive use of fiberglass or light alloy panels to minimize the weight of the container.

According to a second aspect of this invention, the railway car which is used to transport the container of this invention includes at least two container attachment structures, each mounted to the spine to extend below an upper surface of the spine such that each of the attachment structures contacts the container at a point lower than the upper surface of the spine in order securely to mount the container to the car. As will be explained in detail below, the container of this invention can be mounted to the railway car of this invention by means of these attachment structures. In addition, two or more containers can be stacked one above the other, with the central ridge of the lower container extending into the longitudinally extended central recess between the skirts of the upper container.

The novel container and railway car of this invention provide a number of significant advantages over conventional rectangular containers, as will be described in detail below. At this point, it is enough to emphasize that the preferred embodiments of the container of this invention provide an unusually low center of gravity when used to transport bulk cargo, that they provide excellent aerodynamic characteristics, that they are strong and light in weight and well suited for transporting heavy bulk cargos, that they can be stacked when necessary for storage or transport, and that they can be used to transport either bulk or palletized cargo.

The invention itself, together with further objects and attendant advantages, will best be understood by reference to the following detailed description taken in conjunction with the accompanying drawings.

DETAILED DESCRIPTION OF THE PRESENTLY PREFERRED EMBODIMENTS

Figure 2:
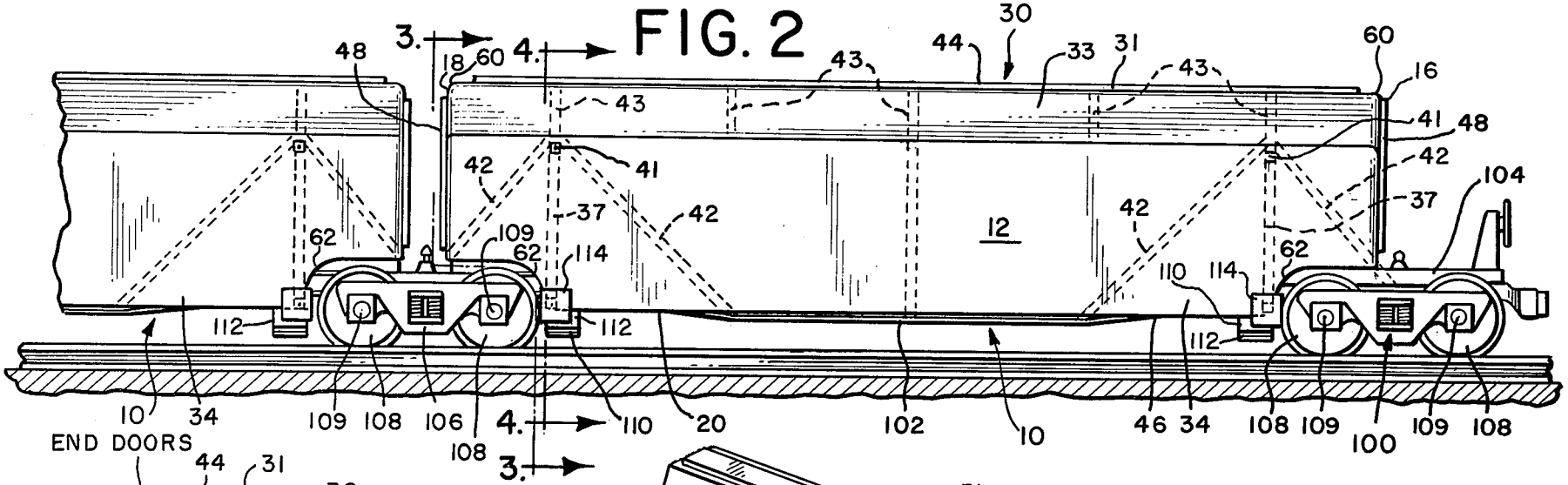
FIG. 2 is an side elevational view of the container and car of FIG. 1.

Turning now to the drawings, FIGS. 1 through 6 depict various views of a first preferred embodiment of the container and railway car of this invention. As shown in these figures, the container 10 includes two spaced, parallel side walls 12,14 and two spaced, parallel end walls 16,18. The side walls 12,14 and end walls 16,18 cooperate to define a peripheral wall which extends around the perimeter of the container 10. This peripheral wall is enclosed at its lower edge by a bottom 20 and at its upper edge by a top 30.

Figure 4:
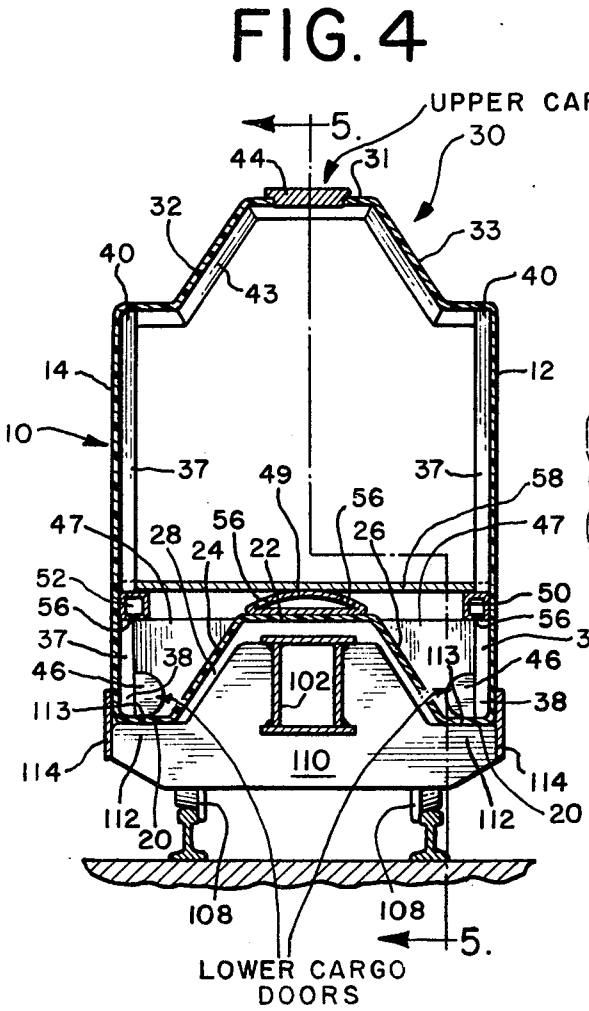
FIG. 4 is a sectional view taken along line 4—4 of FIG. 2.

As best seen in FIG. 4, the bottom 20 is made up of three sections: a central section 22 which extends centrally and longitudinally down the length of the container 10, and two side sections 24,26 which extend below the central section 22 along the length of the container 10. The central section 22 cooperates with the side sections 24,26 to define an elongated, longitudinally oriented central recess 28 which extends from end to end of the container 10.

The top 30 defines a central ridge 31 which is bounded on either side by a respective sloping side panel 32,33. As shown in FIG. 4, the central ridge 31 defines a shape or contour which corresponds to that of the central recess 28. As will be explained in detail below in connection with FIGS. 6 and 7, this correspondence between the contour of the bottom 20 and the top 30 plays an important role when the container 10 is stacked. The side sections 24,26 of the bottom 20 cooperate with the lower portions of the side walls 12,14 to define two elongated skirts 34,36. The skirts 34,36 are in communication with the interior of the container 10 and serve as a portion of the cargo carrying volume of the container 10.

Figure 5:
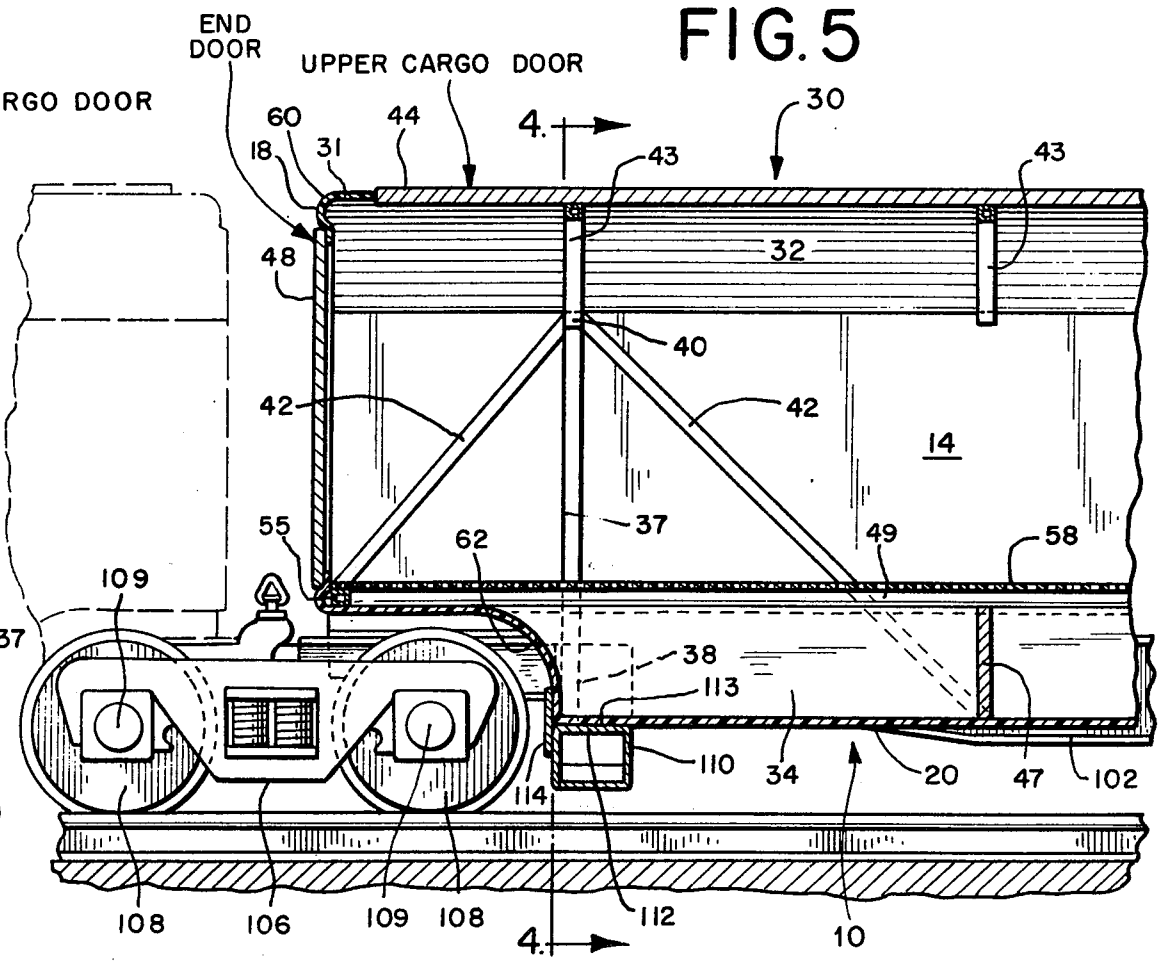
FIG. 5 is a partial sectional view taken along line 5—5 of FIG. 4.

Turning now to FIG. 5, the container 10 includes an interior framework of stiffening elements which strengthen the container 10 so as to make it self-supporting. This framework includes four vertically oriented uprights 37, two of which are affixed to each of the side walls 12,14. In this preferred embodiment, each of the uprights 37 is formed of a hollow, rectangular member. The upper ends of each of the uprights 37 extend through the top 30 and serve to define respective upper anchor members 40. Similarly, the lower ends of each of the uprights 37 extend through the bottom 20 and serve to define lower anchor members 38. As will be explained below, the anchor members 38,40 serve to receive spring-loaded latches used to secure the container 10 in place, either on the railway car, or on another container. In addition, each of the uprights 37 defines two side lifting recesses 41, which can be used as lifting points to attach cranes and the like to lift the container 10. Thus, the uprights 37 serve to strengthen and support the side walls 12,14, to transmit loads via the anchor members 38,40 to underlying support surfaces, and to transmit loads via the side lifting recess 41 to lifting structures.

In addition, the frame includes frame diagonals 42 which extend from the uprights 37 as shown in FIG. 2 and are bonded to the side walls 12,14. These diagonals 42 serve further to strengthen and support the side walls 12,14. Also shown in FIG. 5 are a plurality of arches 43 which are secured to the top 30 so as to brace and reinforce the top 30. The two outermost arches 43 are rigidly secured to the respective uprights 37, while the three inner arches 43 are bonded directly to the top 30. As shown in FIG. 4, a plurality of partitions 47 are mounted to extend completely across the skirts 34,36, such that each of the skirts 34,36 is divided into four sections. These partitions 47 are mounted between the lower portions of the side walls 12,14 and the side sections 24,26 as shown in FIG. 4 in order to reinforce and strengthen the skirts 34,36.

In addition, two air ducts 50,52 are bonded to the side walls 12,14 above the skirts 34,36. Each of these air ducts 50,52 is rectangular in cross section and hollow, and the ducts 50,52 serve simultaneously as structural members to strengthen and support the side walls 12,14 and as conduits to pass treated air along the length of the container 10. A sill 49 is mounted on the bottom 20 within the container 10 directly above the central section 22. This sill 49 extends longitudinally along the length of the container 10, parallel to the air ducts 50,52, and it serves as a further longitudinally reinforcing structural member. As shown in FIG. 4 the sill 49 is preferably hollow so as to provide an air passage extending along the length of the container 10.

In order to reinforce the container 10 against spreading of the side walls 12,14, a perforated floor 58 is mounted between the air ducts 50,52 above the skirts 34,36. This perforated floor 58 acts in tension to prevent the side walls 12,14 from spreading. Preferably, the perforated floor 58 is provided with large perforations which act to allow bulk cargo such as grain to pass through the floor as necessary. However, it should be understood that the perforations in the floor 58 are preferably sufficiently small so as to allow palletized cargo and loading equipment such as forklifts to be supported adequately by the floor 58.

The container 10 is provided with a number of doors and hatches. An upper bulk cargo door or hatch 44 extends along the length of the central ridge 31. In this preferred embodiment, the upper hatch 44 is formed of a fiberglass panel hinged along one edge to the top 30. The hatch 44 can be made of one elongated panel which extends along the entire length of the ridge 31. Alternatively, the upper hatch 44 can be segmented into a number of separate doors. Whatever the configuration chosen for the upper hatch 44, it should be dust- and weatherproof so as to prevent the entry of water or moisture into the container once the hatch 44 has been closed and secured. The upper hatch 44 is used for loading bulk cargo into the container 10.

The container 10 also includes two lower bulk cargo doors or hatches 46, each of which extends along the lowermost portion of a respective one of the two skirts 34,36. These lower doors 46 are used for unloading bulk cargos from the container 10, and they also provide further longitudinal reinforcement to the container 10. Various types of weatherproof and leakproof doors can be used for the lower doors 46; however, in this preferred embodiment the doors 46 are rotating cylindrical doors such as those marketed by Morrison-Knudson Co., Inc. of Boise, Idaho. Once again, the length of the lower doors 46 can be chosen to fit the individual application. In this preferred embodiment, each of the lower doors 46 is made up of four 10-foot segments, each extending between adjacent partitions 47. Of course, segments of other lengths may well be suited for use in alternative embodiments.

Figure 1:
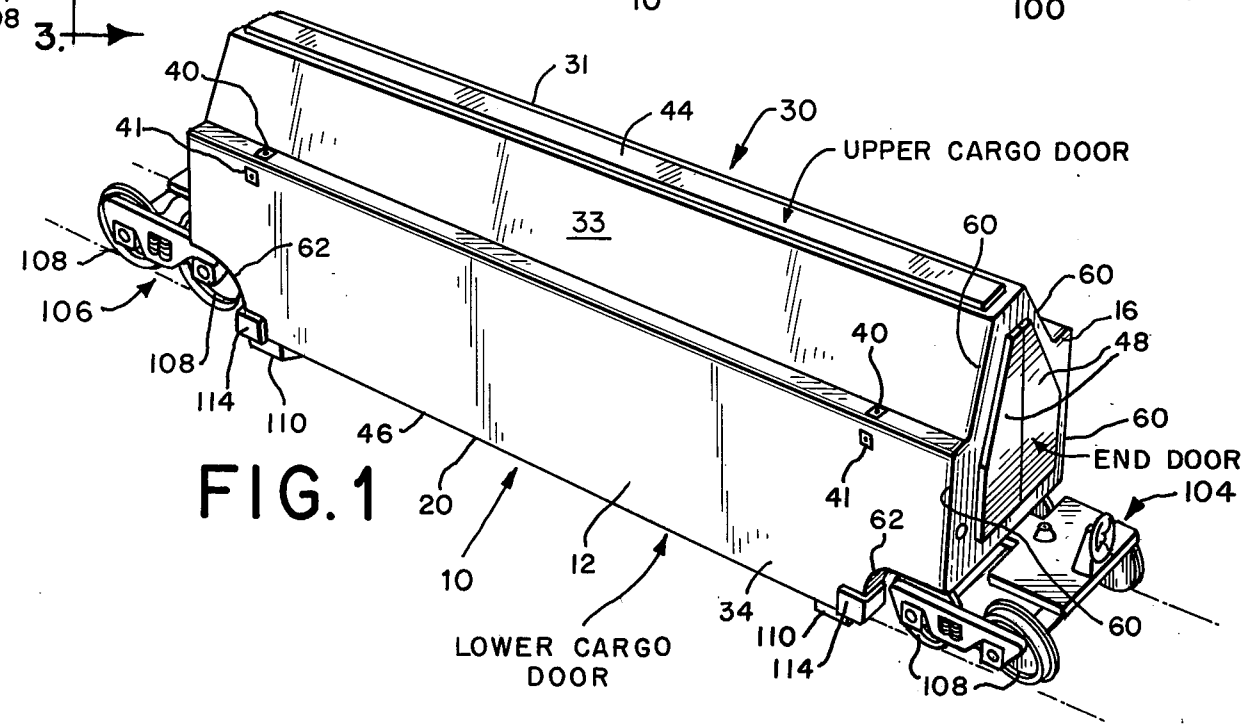
FIG. 1 is a perspective view of a presently preferred embodiment of the container of this invention mounted on a presently preferred embodiment of the railway car of this invention.
Figure 3:
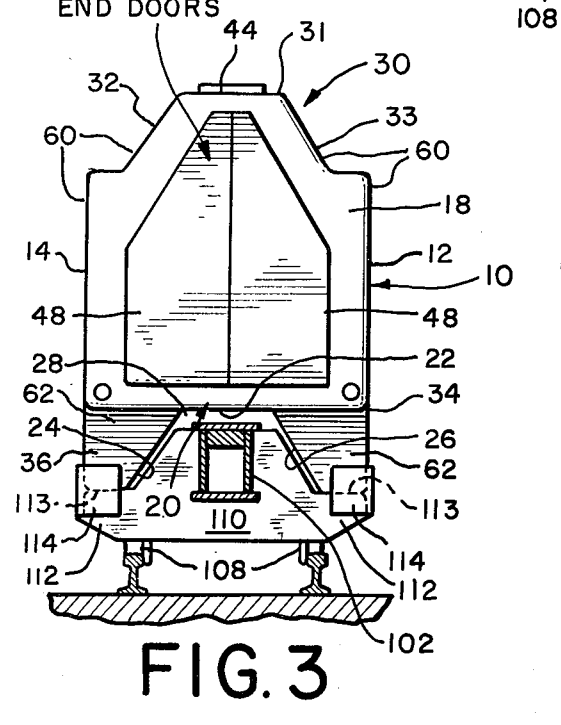
FIG. 3 is an end elevational view, taken along line 3—3 of FIG. 2.

As shown in FIGS. 1 and 3, the container 10 also includes two end doors 48, each of which is mounted in a respective end wall 16,18 to provide access to the interior of the container above the floor 58. These end doors 48 are mounted on hinges to the respective end walls 16,18, so as to open in the conventional manner. Once again, the doors 48 should provide a weatherproof seal once closed and secured.

The air ducts 50,52 and the interior of the sill 49 are all connected to manifolds 55 which extend across each end of the container 10. Both the air ducts 50,52 and the sill 49 define downwardly directing air nozzles 56. These nozzles 56 serve to direct air from the interior of the ducts 50,52 and the sill 49 into the interior of the container 10. In turn, the manifolds 55 are adapted to be connected by conventional means, not shown, to a source of treated air. For example, the manifolds 55, ducts 50,52 and sill 49 can be coupled to a pumping unit (not shown) for supplying heated, dried air in order to dry the contents of the container 10.

As shown in FIG. 1, each end of the container 10 is provided with rounded corners 60 which provide a smooth, rounded transition between the end walls 16,18 and the side walls 12,14 and the top 30. These rounded corners 60 provide smooth, aerodynamically efficient surfaces which reduce air turbulence and air drag when the container 10 is transported. In addition, each of the skirts 34,36 defines a respective wheel well 62 at each end thereof. As will be explained below, these wheel wells 62 serve to reduce air turbulence around the trucks of the railway car on which the container 10 is transported, thereby further reducing wind drag and related loses.

Merely by way of example, and not as a limitation, the preferred embodiment of the container 10 described above is constructed with the following preferred dimensions. The width of the container between the side walls 12,14 is eight feet. The height of the container 10 between the lowermost portion of the skirts 34,36 and the uppermost portion of the ridge 31 is 10 feet, 3 inches. The height of the central ridge 31 is 30 inches and the height of the central recess 28 is also 30 inches. The length of the container 10 between the end walls 16,18 is 45 feet, and the length of the container 10 between the uprights 37 is 35 feet. The rounded corners 60 are provided with a radius curvature of 8 inches, and the width of both the central section 22 and the uppermost surface of the central ridge 31 is 24 inches.

The container 10 has been designed to maximize the use of light weight materials. Alternative embodiments can employ either fiberglass or light weight alloy panels formed of aluminum, magnesium or stainless steel alloys to make up the side walls 12,14, the end walls 16,18, the bottom 20 and the top 30. Although these elements have been discussed separately, it should be emphasized that with many fabrication techniques, multiple panels may be formed as a single unit. By using such materials, the weight of the container 10 can be minimized, while providing an adequate strength to allow the entire internal volume of the container 10 to be filled with bulk cargo such as grain. Preferably, the side walls are corrugated in the longitudinal direction in order further to strengthen the car 10. The contour of the bottom 20 and the rounded corners 60 provide additional structural strength.

As shown in FIG. 1, the container 10 can be mounted on a railway car 100. This railway car 100 includes a longitudinally extending central spine 102 which is supported at each end by a respective truck 104,106. Each of the trucks 104,106 includes a plurality of wheels 108, each of which rotates about a respective rotational axis 109.

FIG. 4 is a sectional view which shows one of the two container bolsters 110 which are mounted to each of the cars 100. Each container bolster 110 is made up of two spaced, parallel plates which are securely fastened to the spine 102 so as to extend transversely to the spine 102. Each of the bolsters 110 defines two spaced container pedestals 110, one on either side of the spine 102. Each of the pedestals 112 defines a horizontally oriented support surface 113 which is bounded on two sides by respective flanges 114. A fastening member 116 such as a spring-loaded latch extends up through the support surface 113. FIG. 4 illustrates the manner in which the container 10 fits on the railway car 100, with the spine 102 received within the central recess 28.

Figure 6:
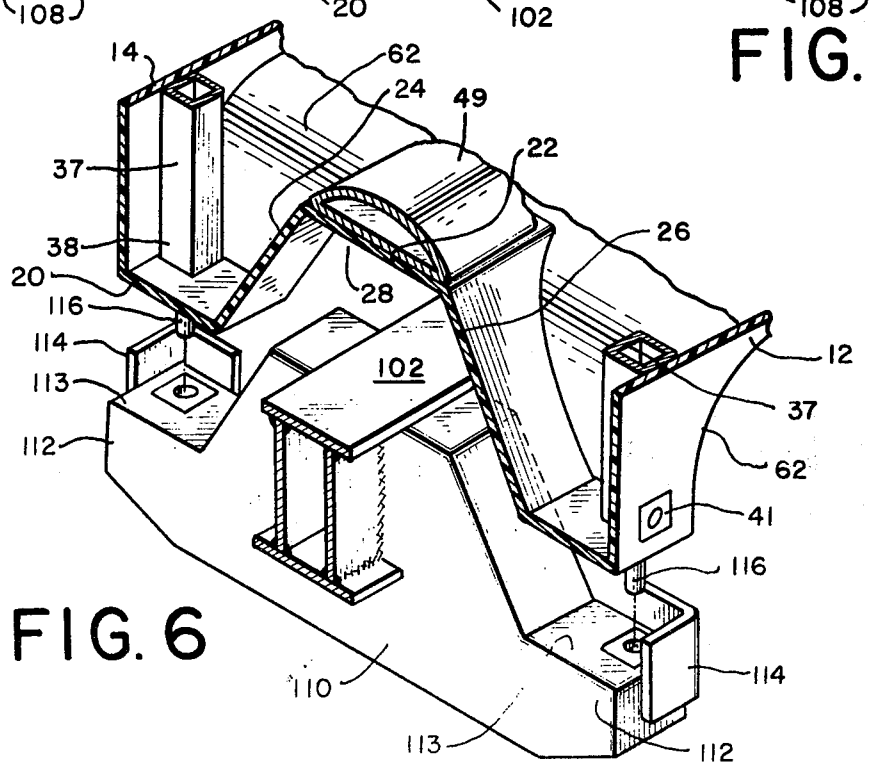
FIG. 6 is a fragmentary persepective view of a portion of the container of FIG. 1, positioned above the car of FIG. 1.

When the container 10 is mounted on the car 100, each of the lower anchor members 38 rests on a respective support surface 113 of a respective container bolster 100, such that the entire weight of the container 10 and its contents is transferred to the car 100 via the support surfaces 113. Each of the fastening members 116 extends up into the respective lower anchor member 38 so as to fasten the container 10 securely to the car 100, as shown in FIG. 6. The flanges 114 serve to provide additional lateral and fore and aft alignment for the container 10 on the car 100. Suitable fastening members 116 can be obtained from MacLean-Fogg Co. of Mundelein, Ill.

With certain exceptions to be noted below, the car 100 is similar to the railway car disclosed in detail in Adams U.S. Pat. No. 4,233,909, which is hereby incorporated herein by reference for its detailed description of the car 100. Important differences between the railway car described in the Adams patent and the railway car 100 can be summarized as follows.

First, the platform 32 and the extension 28 used by Adams to support a trailer are unnecessary for the car 100 of this invention and have been removed. Second, heavier duty trucks 104,106 have been used in the car 100 so as to allow greater weights to be transported on the car 100. In the presently preferred embodiment, each of the trucks 104,106 is a 125-ton truck having wheels 106 which are 38 inches in diameter. The trucks 104,106 have been mounted to the spine 102 in such a manner as to preserve the clearances necessary for horizontal curves having a 200 foot radius and vertical curves having a 2300 foot radius. Third, the car 100 has been provided with bolsters 110 which provide container support surfaces 113 which are situated below the uppermost surface of the spine 102. In this preferred embodiment, each of the support surfaces 113 is positioned 18 inches above the uppermost surface of the rails on which the car 100 travels. As the radius of the wheels 108 is 19 inches, this results in a car 100 in which the support surfaces 113 are positioned below the axes of rotation 109 of the wheels 108.

FIGS. 1–8 show two different aspects of the manner in which the container 10 can be used with the car 100. In FIGS. 1–6 a single container 10 is mounted on each of the cars 100. This is the standard configuration which is used in transporting a laden container 10 by rail. Once the fastening members have been used to secure the container to the respective car 100, the container 10 rides on the car much as a standard railway car. As explained above, the cargo carrying skirts 34,36 provide an exceptionally low center of gravity when bulk cargos are carried.

FIG. 1 illustrates a number of the aerodynamic advantages of the container 10. The rounded corners 60 cooperate with the narrow spacing between adjacent cars 10 to reduce the aerodynamic drag of the cars through the air. In this preferred embodiment, adjacent cars 10 are separated by only 10 inches. In addition, FIG. 1 shows the manner in which the trucks 104,106 fit partially within the wheel wells 62 of the car 10, such that the skirts 34,36 act to shield the wheels 108 from turbulent air. In this way, aerodynamic drag is further reduced.

Moreover, the sloping sides 32 of the central ridge 31 provide a lower drag against side winds, as compared to a vertical wall. By keeping the vertical side walls low and close to the track, the container 10 is rendered less susceptible to tipping movements due to side winds.

Figure 7:
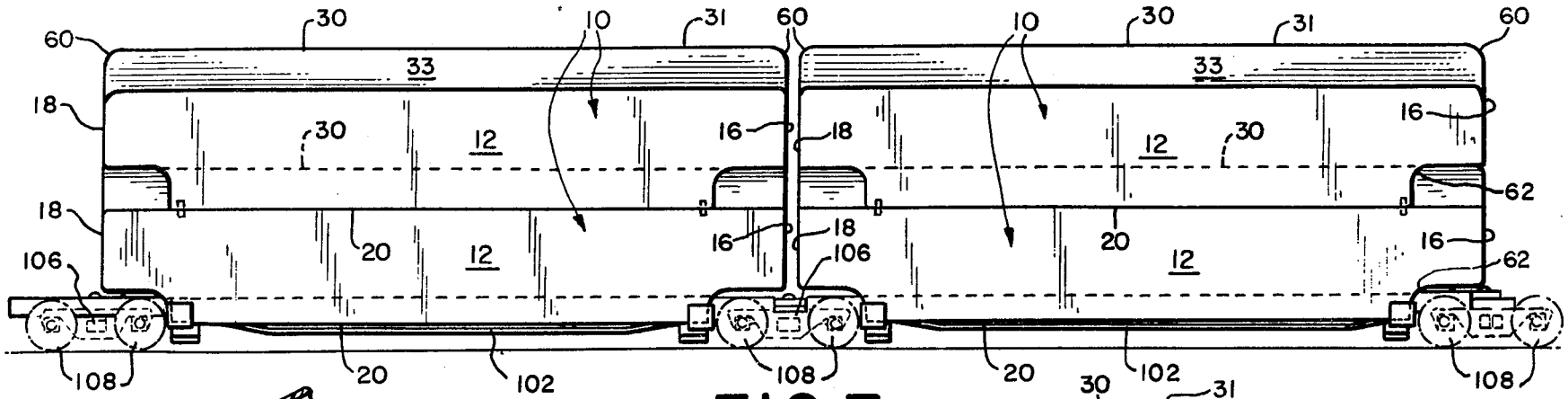
FIG. 7 is a side elevational view of two adjacent cars, each carrying two stacked containers, each similar to the container of FIG. 1.
Figure 8:
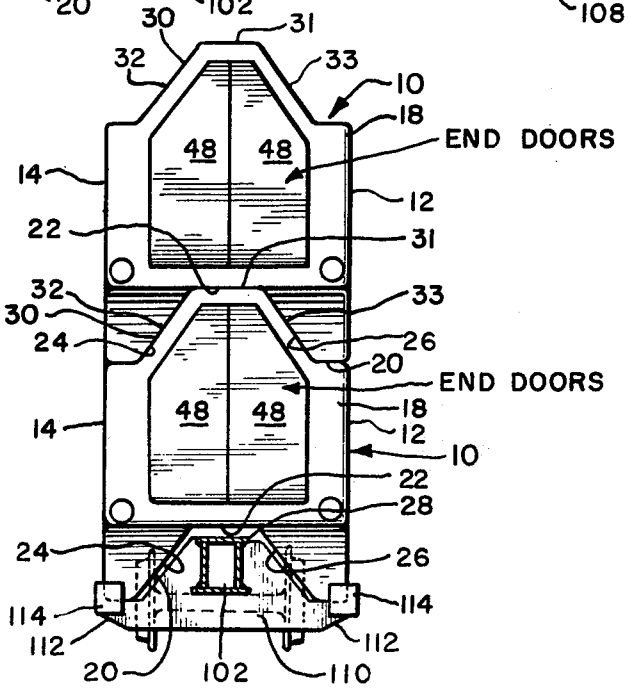
FIG. 8 is an end elevational view of the stacked containers of FIG. 7.

As shown in FIGS. 7 and 8, two of the containers 10 can be stacked, one over the other. When so stacked, the lower anchor members 38 of the upper container rest on the upper anchor members 40 of the lower container, and are held in place by fastening members (not shown). The contour of the top 30 corresponds to that of the bottom 20 to facilitate stacking. As used herein the term "correspond" is used in its broad sense to characterize contours which can be nested, regardless of differences in shape which do not interfere with nesting. The container 10 has been designed such that an empty container can be stacked on a loaded container and then be transported by rail. When stacked, the ridge 31 of the lower container fits and interlocks within the recess 28 of the upper container. Preferably the interlock between the ridge 31 and the recess 28 is close enough to prevent significant aerodynamic drag at the junction between the two containers.

It should be understood that the container 10 is not limited to transportation by rail. Rather, it can also be transported by ship or by road on specially modified trailers having central spines shaped to fit within the central recess of a container and attachment structures similar to the bolsters 110. If properly ballasted and shaped, the container 10 may even be towed in water, in which case the skirts 34,36 act as twin catamaran hulls. The container of this invention can even be used for storage, for example for the storage of bulk grain at a farm or grain elevator. Thus, the container of this invention is well adapted for use in a transportation system in which a bulk cargo is stored and shipped via multiple modes of transportation, without ever being unloaded or transferred from one container to another. In this way, damage to bulk cargo due to handling can be reduced. In addition, the preferred container described above can be used to transport either bulk or palletized cargo, thereby reducing the number of empty return trips and further reducing transportation costs.

Of course, it should be understood that many changes and modifications to the preferred embodiments described above will be apparent to those skilled in the art. Details of construction, materials, and geometry as well as details of the doors and hatches can be adapted to fit individual applications. For example, the end door can be modified and mounted on the side walls of the container. Alternately, some embodiments may have tops and bottoms which are more curved with fewer corners than the illustrated embodiment and not all containers need be cylindrically symmetrical. It is therefore intended that the foregoing detailed description be regarded as illustrative rather than limiting, and that it be understood that it is the following claims, including all equivalents, which define the scope of this invention.

We claim:

1. A container configured to be transported on a railway car of the type having a central, longitudinally extending spine supported at each end by a respective truck, said container comprising:

a housing comprising a peripheral wall, a bottom section secured to a lower edge of the wall, and a top section secured to an upper edge of the wall; and means for releasably anchoring the container to the car to position the container with respect to the car;

said bottom section defining a raised elongated central section, shaped to overlie the spine of the car when the housing is positioned on the car, and a pair of longitudinally extending skirts, one on each side of the central section, positioned to extend alongside and below the spine between the trucks when the housing is positioned on the car;

said top section defining a central ridge positioned over the central section of the bottom section such that the top section defines a contour which corresponds to that of the bottom section to facilitate stacking of the housing;

said skirts forming a cargo-carrying portion of the container;

said bottom section shaped to clear the spine such that the container can be lowered onto and lifted off of the railway car.

2. The invention of claim 1 wherein the peripheral wall, the bottom section, and the top section comprise respective light alloy panels.

3. The invention of claim 1 wherein the peripheral wall, the bottom section, and the top section comprise respective fiberglass panels.

4. The invention of claim 1 wherein the anchoring means comprises four anchor members, each positioned at a respective lower end portion of a respective one of the two skirts, each anchor member positioned and designed to secure the container to a respective container attachment structure included in the railway car.

5. The invention of claim 1 wherein each of the skirts defines a respective wheel well at each end of the skirt, each wheel well shaped to provide an aerodynamic shield for a respective one of the wheels of the railway car.

6. The invention of claim 1 wherein a respective longitudinally extending lower hatch is provided along the lowermost portion of at least one of the skirts.

7. The invention of claim 1 or 6 wherein a longitudinally extending upper hatch is provided along the uppermost portion of the central ridge.

8. The invention of claim 1 or 6 wherein the container further comprises a perforated floor extending across the peripheral wall above the skirts to support a plurality of cargo pallets, said floor operating to reinforce the container structurally to prevent undesired distortion of the peripheral wall.

9. The invention of claim 8 wherein the container further comprises at least one door mounted in the peripheral wall to admit said cargo pallets into the container.

10. The invention of claim 8 wherein the container further comprises:

an air duct rigidly fastened to an interior surface of the container to extend longitudinally along the peripheral wall, said air duct simultaneously acting to reinforce the peripheral wall and to support the floor and adapted to receive air from an external source; and means for admitting air from the duct into the container.

11. A cargo container for use with a railway car of the type having a longitudinally extending central spine supported at each end by a respective truck, each truck having a plurality of wheels, each having an upper edge, said container comprising:

a bottom having a raised, longitudinally extending central portion shaped to overlie the spine and two lowered, longitudinally extended side portions, each shaped to extend alongside the spine between the trucks;

first and second side walls, each mounted to a respective side portion of the bottom to extend parallel to the spine, each side wall including a lower portion which extends below the upper edges of the wheels;

first and second end walls, each mounted to extend between the side walls at a respective end and secured to the bottom;

a top having a raised, longitudinally extending ridge having a shape corresponding to that of the bottom, said top mounted to the side walls and the end walls to enclose the container; and means for releasably anchoring the container to the car to position the container with respect to the car;

said bottom, side walls, end walls, and top cooperating to define a bulk cargo container having storage capacity of bulk cargo below the upper edges of the spine;

said bottom shaped to clear the spine such that the container can be lowered onto and lifted off of the railway car.

12. The invention of claim 11 wherein each of the wheels define a respective rotational axis, and each of the side walls, end walls, and bottom extends below the rotational axes.

13. The invention of claim 11 wherein the bottom, side walls, end walls, and top comprise respective fiberglass panels.

14. The invention of claim 11 wherein the bottom, side walls, end walls, and top comprise respective light alloy panels.

15. The invention of claim 11 wherein the anchoring means comprises a plurality of anchor members adapted to anchor the container to the car, each anchor member positioned on a side wall adjacent the bottom.

16. The invention of claim 11 wherein each of the side portions of the bottom defines a respective wheel well at each end thereof, each wheel well shaped to provide an aerodynamic shield for a respective one of the wheels of the railway car.

17. The invention of claim 11 wherein the invention further comprises an upper bulk cargo loading door extending longitudinally along the ridge.

18. The invention of claim 11 or 17 wherein the invention further comprises a pair of lower bulk cargo unloading doors, each extending longitudinally along the bottom adjacent a respective one of the side walls.

19. The invention of claim 11 wherein the invention further comprises a floor extending between the side walls to support cargo pallets and to strengthen the side walls, said floor being perforated to allow bulk cargo to pass through the floor.

20. The invention of claim 19 wherein the invention further comprises at least one side loading door mounted in one of the end and side walls.

21. The invention of claim 19 wherein the invention further comprises a pair of air ducts, each mounted to a respective side wall to strengthen the respective side wall and to support the floor.

22. A container assembly adapted to be transported on a railway car of the type having a central spine supported at each end by a respective truck, said assembly comprising:

a first container comprising a first peripheral wall having an upper edge and a lower edge, a first bottom section secured to the lower edge of the wall, a first top section secured to the upper edge of the wall, and means for releasably anchoring the first container to the railway car to position the first container with respect to the car; said first bottom section defining a raised, longitudinally extending central section shaped to overlie the spine and a pair of downwardly extending, cargo carrying skirts, each positioned on a respective side of the central section to extend alongside the spine; said first top section defining a raised central ridge having a contour substantially corresponding to that of the first bottom section, said first bottom section shaped to clear the spine such that the first container can be lowered onto and lifted off of the railway car;

a second container comprising a second peripheral wall, a second bottom section, and a second top section, said second bottom section having a contour corresponding to that of the first top section, including a longitudinally extending central recess shaped to receive the central ridge of the first container; said second container positioned over the first container with the central ridge of the first container positioned within the central recess of the second container and the first and second peripheral walls in alignment; and means for fastening the first container to the second container such that the first and second containers can be stored and transported as a unit.

23. The invention of claim 22 wherein the fastening means comprises:

a plurality of upper anchor members, mounted on the first container near an upper portion of the first peripheral wall;

a plurality of lower anchor members, mounted on the second container in alignment with the plurality of upper anchor members; and a plurality of fastening members, each extending between a respective one of the second plurality of lower anchor members and the aligned one of the first plurality of upper anchor members, said upper and lower anchor members and fastening members cooperating to transfer the weight of the second container to the first container.

24. The invention of claim 22 wherein each of the first and second containers includes a respective upper bulk cargo door extending longitudinally along the respective top section.

25. A car for carrying a container having a bottom section defining a raised, elongated central section and a pair of longitudinally extending skirts, each positioned to extend alongside and below a respective side of the central section, said container having at least two anchor members, each positioned at a respective lower portion of a respective one of the skirts, said car comprising:

a central spine shaped to fit between the skirts adjacent the spine such that the skirts extend below at least a portion of the spine;

a pair of trucks, each mounted to a respective end of the spine to support the spine, each of said truck including a plurality of wheels, each rotatable about a respective axis;

at least two container attachment structures for positioning the container with respect to the car; and means for mounting the at least two container attachment structures to the spine, said mounting means shaped to clear the bottom section of the container such that each of the attachment structures contacts the container at a point lower than the upper surface of the spine adjacent a respective anchor member in order to provide a secure and stable mounting of the container to the car.

26. The invention of claim 25 wherein the container comprises four anchor members and the car comprises four container attachment structures, each mounted to contact the container adjacent a respective anchor member.

27. The invention of claim 26 wherein the four container anchor members are positioned to contact the container at four respective, coplanar points.

28. The invention of claim 25 or 26 or 27 wherein each of the attachment structures contacts the container at a point substantially at least as low as the axes.

29. The combination of a railway car and container comprising:

a railway car comprising:

a central spine extending in a longitudinal direction;

a pair of trucks, each mounted to support a respective end of the spine, each truck comprising at least two wheels mounted on an axle; said axles being substantially coplanar; and a pair of bolsters, each secured to the spine near a respective truck, said bolster including two spaced pedestals, each positioned on a respective side of the spine at a point lower than an upper surface of the spine; a cargo container comprising:

a peripheral wall having a lower edge and an upper edge;

a bottom section secured to the lower edge of the peripheral wall, said bottom section defining a longitudinally extending central section above and adjacent the spine and a pair of downwardly extending, cargo carrying skirts, each skirt positioned adjacent a respective side of the spine between the trucks;

a top section secured to the upper edge of the peripheral wall, said top section defining a raised central ridge having a contour corresponding to that of the bottom section; and four anchor members, each mounted at a respective lower end portion of a respective one of the skirts adjacent a respective one of the pedestals; and means for releasably fastening each of the anchor members to the respective pedestal to secure the container to the car;

said bottom section shaped to clear the spine such that the container can be lowered onto and lifted off of the railway car.

30. The invention of claim 29 wherein each end of each skirt defines a respective wheel well shaped to shield the respective truck from air flow.

31. The invention of claim 29 wherein each of the pedestals is positioned substantially at least as low as the plane of the axles.

32. The invention of claim 29 wherein the container further comprises a bulk cargo loading door mounted to the top section and extending longitudinally along the central ridge, and a pair of bulk cargo unloading doors, each mounted to the bottom section and extending longitudinally along a respective one of the two skirts.

33. The invention of claim 29 or 32 wherein the container further comprises a perforated floor extending across the container above the bottom section to support a plurality of cargo pallets, and a pallet loading door mounted in the peripheral wall to provide access to the floor.

* * * * *

UNITED STATES PATENT AND TRADEMARK OFFICE

CERTIFICATE OF CORRECTION

PATENT NO. : 4,478,155

DATED : October 23, 1984

INVENTOR(S) : Lawrence Cena and Ted D. Mason

It is certified that error appears in the above-identified patent and that said Letters Patent is hereby corrected as shown below:

IN THE REFERENCES CITED
U.S. PATENT DOCUMENTS

Please add the following:

3,583,330 6/1971 - Freudman et al. ...105/360XR
3,583,331 6/1971 - Mowatt-Larsen (B)..105/360
3,572,252 3/1971 - Coover et al. .....105/248
3,557,714 1/1971 - Aguino, et al. ....105/406(R)
3,557,708 1/1971 - Bolte (B) .....105/4(R)
3,583,335 6/1971 - Schiff et al. .....105/377

IN THE SUMMARY OF THE INVENTION

In column 2, line 12, please delete "clargo" and substitute therefor --cargo--.

IN THE CLAIMS

In claim 11 (column 9, line 40), please delete (first occurrence) "of" and substitute therefor --for--;

UNITED STATES PATENT AND TRADEMARK OFFICE

CERTIFICATE OF CORRECTION

PATENT NO. : 4,478,155

DATED : October 23, 1984

INVENTOR(S) : Lawrence Cena and Ted D. Mason

It is certified that error appears in the above-identified patent and that said Letters Patent is hereby corrected as shown below:

In claim 12 (column 9, line 46), please delete "define" and substitute therefor --defines--;

In claim 25 (column 11, line 16), please delete "of said";

In claim 29 (column 12, line 2), please delete "said" and substitute therefor --each--.

Signed and Sealed this

Fifth Day of April, 1988

*Attest:*

*Attesting Officer*

DONALD J. QUIGG

*Commissioner of Patents and Trademarks*